US009480891B2

(12) United States Patent
Ono et al.

(10) Patent No.: US 9,480,891 B2
(45) Date of Patent: Nov. 1, 2016

(54) METAL SHAFT HAVING LONGITUDINALLY VARYING HARDNESS, GOLF SHAFT USING THE METAL SHAFT, GOLF CLUB USING THE METAL GOLF SHAFT, METHOD OF MANUFACTURING THE METAL SHAFT, AND TEMPERING APPARATUS

(71) Applicant: NHK Spring Co., Ltd., Yokohama-shi, Kanagawa (JP)

(72) Inventors: Hiroyuki Ono, Yokohama (JP); Masahito Iwase, Yokohama (JP)

(73) Assignee: NHK Spring Co., Ltd., Kanagawa (JP)

( * ) Notice: Subject to any disclaimer, the term of this patent is extended or adjusted under 35 U.S.C. 154(b) by 0 days.

(21) Appl. No.: 14/798,677

(22) Filed: Jul. 14, 2015

(65) Prior Publication Data

US 2016/0030817 A1 Feb. 4, 2016

(30) Foreign Application Priority Data

Jul. 30, 2014 (JP) ..... 2014-155528

(51) Int. Cl.

| | |
|---|---|
| ***A63B 53/12*** | (2015.01) |
| ***B21C 37/06*** | (2006.01) |
| ***C21D 1/18*** | (2006.01) |
| ***C21D 9/00*** | (2006.01) |
| ***C21D 9/08*** | (2006.01) |
| ***C22C 38/00*** | (2006.01) |

(52) U.S. Cl.

CPC ..... *A63B 53/12* (2013.01); *B21C 37/06* (2013.01); *C21D 1/18* (2013.01); *C21D 9/0062* (2013.01); *C21D 9/08* (2013.01); *C22C 38/00* (2013.01); *A63B 2209/00* (2013.01)

(58) Field of Classification Search

USPC ..... 473/316, 409, 319–323; 266/129, 132

See application file for complete search history.

(56) References Cited

U.S. PATENT DOCUMENTS

| | | | | |
|---|---|---|---|---|
| 3,871,649 | A * | 3/1975 | Kilshaw | A63B 53/00 29/428 |
| 4,169,595 | A * | 10/1979 | Kaugars | A63B 53/12 473/323 |
| 4,204,892 | A * | 5/1980 | Economopoulos | C21D 9/08 148/332 |
| 4,288,075 | A * | 9/1981 | Kaugars | A63B 53/12 473/323 |
| 4,458,885 | A * | 7/1984 | Akita | C21D 9/085 266/117 |
| 6,273,829 | B1 * | 8/2001 | Carlson | C22C 32/00 473/316 |
| 7,255,652 | B2 * | 8/2007 | Braly | A63B 53/12 473/323 |
| 7,578,750 | B2 * | 8/2009 | Sato | A63B 53/12 266/129 |

FOREIGN PATENT DOCUMENTS

| | | |
|---|---|---|
| JP | 2005-034517 | 2/2005 |

* cited by examiner

*Primary Examiner* — Nini Legesse
(74) *Attorney, Agent, or Firm* — Norris McLaughlin & Marcus, P.A.

(57) ABSTRACT

A metal shaft includes a hollow tube made of metal, capable of having hardness varying in a longitudinal direction of the metal shaft while preventing increase in the number of variations on a shape of the metal shaft. The tube has a hardness pattern exhibited by hardness of the tube varying in a longitudinal direction of the tube according to Young's modulus or tensile strength of the metal varying in the longitudinal direction.

8 Claims, 8 Drawing Sheets

| SIZE | L | A | B | C | WT. |
|---|---|---|---|---|---|
| 41.0 | 1041 | 275 | 241 | | 129.5 |
| 40.5 | 1029 | 263 | 241 | | 129.5 |
| 40.0 | 1016 | 250 | 241 | | 129.5 |
| 39.5 | 1003 | 237 | 241 | | 129.5 |
| 39.0 | 991 | 225 | 241 | | 129.5 |
| 38.5 | 978 | 212 | 241 | | 129.5 |
| 38.0 | 965 | 199 | 241 | | 129.5 |
| 37.5 | 953 | 187 | 241 | | 129.5 |
| 37.0 | 940 | 174 | 241 | | 129.5 |

TARGET CLUB, SHAFT

| NUMBER | LENGTH OF CLUB | WEIGHT | BALANCE | LIE ANGLE (° ) | FP (mm) | LOFT ANGLE (° ) |
|---|---|---|---|---|---|---|
| #7 | 36.75 | 439.7 | D3.0 | 62.3 | 3.0 | 32.0 |

METAL SHAFT HAVING LONGITUDINALLY VARYING HARDNESS, GOLF SHAFT USING THE METAL SHAFT, GOLF CLUB USING THE METAL GOLF SHAFT, METHOD OF MANUFACTURING THE METAL SHAFT, AND TEMPERING APPARATUS

BACKGROUND OF THE INVENTION

1. Field of the Invention

The present invention relates to a metal shaft, a golf shaft using the metal shaft, a golf club using the golf shaft, a method of manufacturing the metal shaft and a tempering apparatus.

2. Description of the Related Art

A conventional metal golf shaft as an example of a metal shaft is disclosed in, for example, JP7005-34517A.

The metal golf shaft is made by carrying out quenching treatment to a tubular steel material having high strength and toughness according to an alloy design so as to transform the same into a martensite structure and then tempering the tubular steel material so as to recover the toughness. This achieves the strength and durability of the golf shaft.

The tempering after the quenching applies heat to the tubular steel material at a uniform temperature in a longitudinal direction at once, thereby to set an approximately constant elastic coefficient over the entire length of the finished golf shaft.

Meanwhile, ability, swing style and the like vary depending on each user and therefore a golf shaft may be required to be suited for each user. For this, it is required to prepare a plurality of variations on the golf shaft, the variations having different wall thicknesses and outer diameters etc. This causes increase in the number of variations on a shape of the golf shaft.

In this case, different processing apparatuses and different processing jigs such as dices and plugs are required to manufacture different golf shafts according to the number of variations on the shape and adjustment better suited for the respective apparatuses and jigs are also required.

Obviously, the number of man-hours for designing the different golf shafts increases according to the number of variations on the shape, to cause a problem of increase in manufacturing cost and time.

Further, it becomes hard to stabilize quality of the different golf shafts as the number of variations on the shape increases. It is a task to provide a product suited for each user while maintaining high quality.

The tempering after the quenching applies heat to the tubular steel material at a uniform temperature in the longitudinal direction as mentioned above, thereby to set an approximately constant tensile strength over the entire length of the finished golf shaft. The golf shaft, therefore, may break or bend by overload that exceeds design stress.

In particular, a joint between a head and the shaft is likely to cause stress concentration and be broken. To prevent such a defect, it is required to thicken a wall thickness or increase an outer diameter at the joint.

This configuration, however, weights a part of the golf shaft to lose a balance of the golf shaft and affect a swing.

Such a problem may be caused a metal shaft product other than the golf shaft such as bat for baseball or softball, ski pole, trekking, pole, and TV antenna for which hardness may be set by tempering after quenching. For example, in a case where such a shaft product has an approximately constant elastic coefficient or tensile strength set over the entire length, it involves increase in the number of variations on a shape when designing different variations according to external force.

SUMMARY OF THE INVENTION

An object of the present invention is to provide a metal shaft, a golf shaft using the metal shaft, a golf club using the golf shaft, a method of manufacturing the metal shaft and a tempering apparatus, capable of having hardness varying in a longitudinal direction of the metal shaft while preventing increase in the number of variations on a shape of the metal shaft.

In order to accomplish the object, a first aspect of the present invention provides a metal shaft including a hollow tube made of metal. The tube has a hardness pattern exhibited by hardness of the tube varying in a longitudinal direction of the tube according to Young's modulus or tensile strength of the metal varying in the longitudinal direction.

A second aspect of the present invention provides a golf shaft comprising the metal shaft of the first aspect. In the golf shaft, the tube of the metal shaft includes a head-attaching portion to which a head is attached on a tip, and a grip-attaching portion to which a grip is attached on a butt.

A third aspect of the present invention provides a golf club comprising the golf shaft of the second aspect. The golf club includes a head attached to the head-attaching portion of the golf shaft, and a grip attached to the grip-attaching portion of the golf shaft.

A fourth aspect of the present invention provides a method of manufacturing the metal shaft. The method quenches a tube made of metal, and tempers the quenched tube while varying a tempering condition in a longitudinal direction of the tube.

A fifth aspect of the present invention provides a tempering apparatus used for the method of the fourth aspect. The apparatus includes a chuck holding an end of a tube made of metal, a chuck driving unit driving the chuck to longitudinally move the chucked tube, a heating unit heating at a setting temperature the tube longitudinally passing through the heating unit at a setting speed, and a tempering control unit controlling the heating unit and the chuck driving unit to vary the setting temperature and/or the setting speed.

The first to third aspects set Young's modulus or tensile strength of the tube so as to vary in the longitudinal direction, thereby to achieve the metal shaft, golf shaft and golf club having the hardness pattern exhibited by the hardness of the metal shaft varying in the longitudinal direction while preventing increase in the number of variations on the shape. Accordingly, the metal shaft, golf shaft and golf club can have various configurations according to characteristics of load acting thereon while keeping the same shape. Further, these aspects reduce the number of variations on the shape of the metal shaft, golf shaft and golf club, to stabilize quality of them.

In particular, the golf shaft can achieve a different hitting feel and a different ball trajectory of the golf club by setting a different hardness distribution of the shaft while maintaining the same shape. Although the golf shaft maintains the same shape, the golf shaft can have the different strength distribution to keep a balance as a golf club.

Further, a design for weight saving and a design for characteristics can be separated so as not to interfere with each other. The aspects, therefore, can provide the golf club having a specification (of a kick point etc.) suited for each user while saving the weight.

The fourth and fifth aspects vary the tempering condition in the longitudinal direction of the tube, thereby to easily obtain the metal shaft whose hardness pattern exhibited by the hardness varying in the longitudinal direction.

DETAILED DESCRIPTION OF EMBODIMENTS

An embodiment according to the present invention will be explained. The embodiment allows a metal shaft to have hardness varying in a longitudinal direction of the metal shaft while preventing increase in the number of variations on a shape of the metal shaft. For this, the metal shaft includes a hollow tube made of metal, the tube having a hardness pattern exhibited by hardness of the tube varying in a longitudinal direction of the tube, the hardness pattern being set by Young's modulus or tensile strength of the metal varying in the longitudinal direction.

A golf shaft using the metal shaft is achieved by being provided with a head-attaching portion to which a head is attached on a tip of the tube of the metal shaft and with a grip-attaching portion to which a grip is attached on a butt of the tube.

The hardness of the tube exhibiting the hardness pattern may curvedly and/or straightly decrease or increase from the tip to the butt.

A golf club using the golf shaft is achieved by attaching a head to the head-attaching portion and a grip to the grip-attaching portion.

A method of manufacturing the metal shaft is achieved by quenching a tube made of metal and tempering the quenched tube while varying a tempering condition in a longitudinal direction of the tube.

The tempering step may heat the quenched tube at a setting temperature with a heating unit while longitudinally passing the quenched tube through the heating unit at a setting speed, the setting temperature and/or the setting speed varying as the tempering condition.

The heating unit may be a heating coil to which a controlled high frequency current is applied. In this case, the setting temperature is a temperature depending on a voltage to be applied to the heating coil and the setting speed is a speed at which the quenched tube passes through a center of a coil shape of the heating coil.

A tempering apparatus used for the method may include a chuck holding an end of a tube made of metal, a chuck driving unit driving the chuck to longitudinally move the chucked tube, a heating unit heating at a setting temperature the moving tube longitudinally passing through the heating unit at a setting speed, and a tempering control unit controlling the heating unit and the chuck driving unit to vary the setting temperature and/or the setting speed.

The heating unit may be a heating coil driven by a high frequency power source. In this case, the tempering control unit controls the high frequency power source to vary the setting temperature and the chuck driving unit to vary the setting speed.

Hereinafter, the embodiment of the present invention will be explained in detail with reference to drawings.

Figure 1:
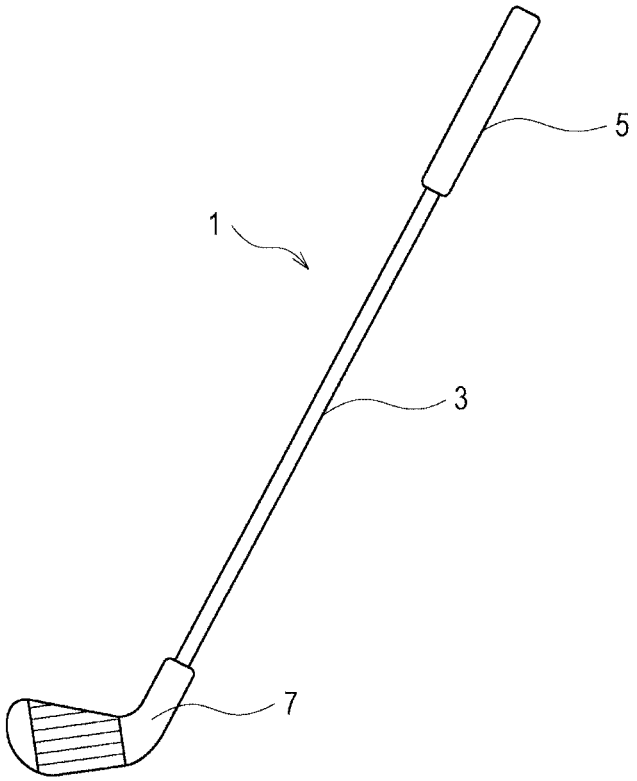
FIG. 1 is a general view illustrating a golf club according to an embodiment of the present invention.

FIG. 1 is a general view illustrating the golf club according to the embodiment of the present invention.

As illustrated in FIG. 1, the golf club 1 is an iron, in particular, a 7-iron as an example of a golf club.

The golf club 1 has the golf shaft 3, the grip 5 and the head 7. The golf shaft 3 has the grip-attaching portion on the butt and the head-attaching portion on the tip. To the grip-attaching portion, the grip 5 is attached as a portion to be gripped or grasped. To the head-attaching portion, the head 7 is attached as a portion for hitting a ball.

The golf shaft 3 is the metal shaft according to the embodiment to which quenching and tempering are carried out. Namely, the golf shaft 3 is one of variations that have hardness varying in a longitudinal direction of the golf shaft 3 and have the same shape so as to prevent increase in the number of variations on a shape. With this, the golf shaft 3 has a configuration according to characteristics of load.

The golf club 1 using the golf shaft 3 may be other irons, drivers or putters. Even when hitting a ball with a putter, delicate feeling of a user is very important. A plurality of variations of putters with different hardness patterns are convenient for users.

Figure 2:
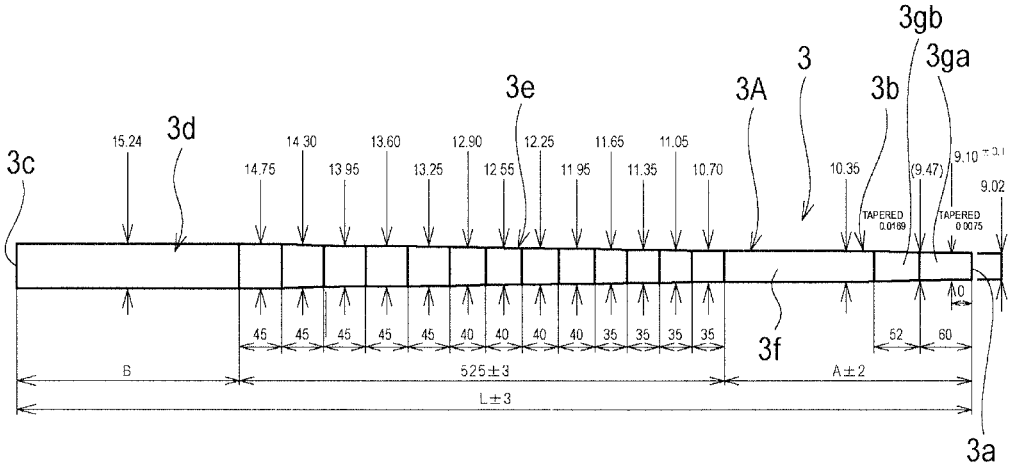
FIG. 2 is a general view illustrating a golf shaft according to the embodiment.
Figures 3, 4:
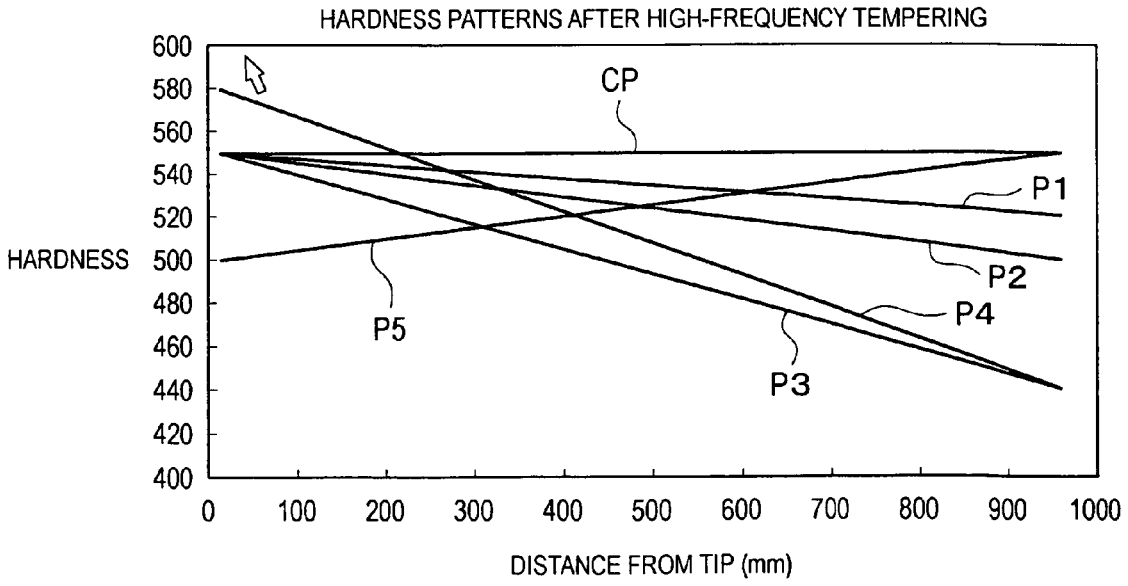
FIG. 3 is a table showing specifications of examples for the golf shaft according to the embodiment.
FIG. 4 is a graph illustrating hardness patterns of variations on the golf shaft according to the embodiment, each one pattern exhibited h hardness varying from a tip to a butt.

FIG. 2 is a general view illustrating the golf shaft 3, and FIG. 3 is a table showing specifications of examples for the golf shaft 3.

The golf shaft 3 is for the 7-iron as mentioned above and is the metal shaft made of a hollow metal tube 3A. According to the embodiment, the material of the tube 3A is steel. However, the metal material other than iron may be used for the golf shaft 3 as long as hardness of the material is adjustable by quenching and tempering.

According to the embodiment, the tube 3A is heated with electromagnetic induction for tempering as mentioned later and the tube 3A or the golf shaft 3 is preferably made of the metal material such as steel heatable with electromagnetic induction. However, other metal materials in which electromagnetic induction is not caused may be used for the tube 3A or the like as long as the materials allows heat treatment to be carried out for quenching and tempering. For example, in a case where a tube is made of a metal material in which electromagnetic induction is not caused, the tube passes through a heating pipe made of a metal material being heatable with electromagnetic induction to indirectly heat and temper the tube.

The tube 3A has the hardness pattern exhibited by the hardness of the tube 3A varying in a longitudinal direction of the tube. The hardness pattern is set by varying Young's modulus or tensile strength of the metal material in the longitudinal direction through the tempering. The hardness pattern and the method of manufacturing the shaft will be explained later.

The tube 3A as the golf shaft 3 has a tip portion 3*b* including a tip 3*a*, the grip-attaching portion 3*d* including a butt 3*c*, and an intermediate portion 3*e* between the tip portion 3*b* and the grip-attaching portion 3*d*. The grip-attaching portion 3*d* functions as a part to which the grip 5 is attached. The tip portion 3*b* includes a tip base 3*f* and head-attaching portions 3*ga* and 3*gb*. The head-attaching portions 3*ga* and 3*gb* function together as a part to which the head is attached.

The specifications of examples for the golf shaft 3 are shown in FIG. 3 in which the column L shows the entire length from the tip 3*a* to the butt 3*e*, the column A shows the length of the tip portion 3*b* and the column B shows the length of the grip-attaching portion 3*d*. The unit for "L," "A" and "B" is the millimeter (mm). The leftmost column "SIZE" of FIG. 3 shows the entire length in inch converted from the column L. The rightmost column "WT" shows the weight of the shaft 3 in gram.

In FIG. 3, the general specifications are represented such that the "SIZE" is in the general range of about 41.0 to 37.0 inches, the "L" is in the general range of about 1041 mm to 940 mm, the "A" is in the general range of about 275 mm to 174 mm, the "B" is the general length of about 241 mm and the "WT" is the general weight of about 129.5 grams. The golf shaft having the specification indicated with the arrow in FIG. 3 is used for trial hitting mentioned below.

The golf shaft 3 has a generally-tapered outer shape so that the tip 3*a* is radially smaller than the butt 3*c*, in the tip portion 3*b* of the golf shaft 3, the head-attaching portions 3*ga* and 3*gb* are two-stage tapered parts and the tip base 3*f* adjoining the head-attaching portion 3*gb* has a uniform outer diameter.

The grip-attaching portion 3*d* of the golf shaft 3 has a uniform outer diameter that is the maximum outer diameter in the golf shaft 3.

The intermediate portion 3*e* of the golf shaft 3 includes multistep straight parts having different outer diameters so that the intermediate portion 3*e* has the outer diameter gradually increases from a part adjoining the tip portion 3*b* to a part adjoining the grip-attaching portion 3*d*. in each straight part, however, the outer diameter is constant.

The golf shaft 3 has a thickness gradually decreasing from the tip 3*a* to the butt 3*c*. The thickness of the golf shaft 3, however, may vary according to requirements for the golf club 1 or golf shaft 3.

FIG. 4 is a graph illustrating hardness patterns of the variations on the golf shaft, each one pattern exhibited by hardness varying from the tip to the butt. In FIG. 4, the abscissa represents a longitudinal distance (mm) from the tip 3*a* and the ordinate represents hardness (Hv).

According to the embodiment, the hardness pattern of the golf shaft 3 is exhibited by the hardness that linearly straightly decreases or increases from the tip 3*a* to the butt 3*b*.

In particular, the hardness patterns P1, P2, P3 and P4 in FIG. 4 are examples according to the embodiment exhibited by the hardness that linearly straightly decreases from the tip 3*a* to the butt 3*b*. The hardness pattern P5 is an example according to the embodiment exhibited by the hardness that linearly straightly increases from the tip 3*a* to the butt 3*b*.

The hardness pattern CP is a comparative example without change in hardness. The comparative example is an ordinary steel shaft.

Figure 5:
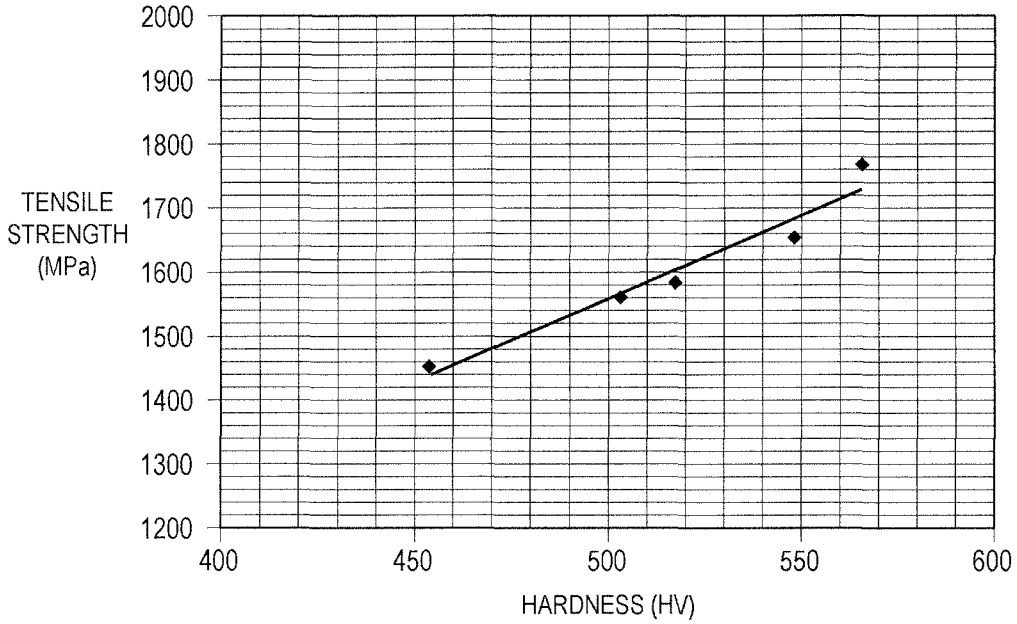
FIG. 5 is a graph illustrating a relationship between hardness and tensile strength for the golf shaft according to the embodiment.
Figure 6:
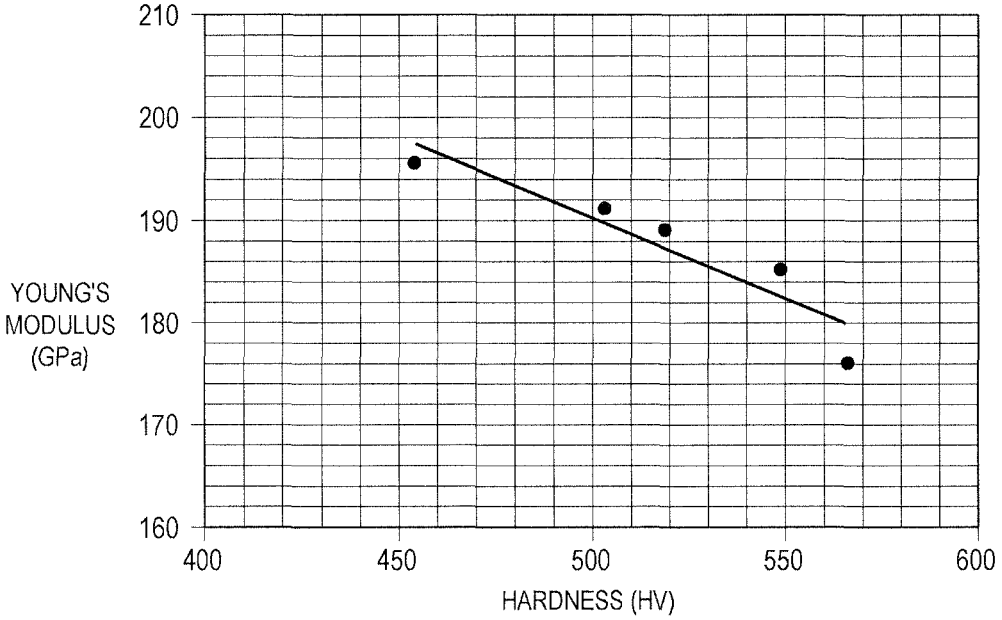
FIG. 6 is a graph illustrating a relationship between hardness and Young's modulus for the golf shaft according to the embodiment.

FIG. 5 is a graph illustrating a relationship between hardness and tensile strength for the golf shaft 3, and FIG. 6 is a graph illustrating a relationship between hardness and Young's modulus for the same.

The inventors of this application have found the relationships between hardness (HV) and tensile strength (MPa) and between hardness (HV) and Young's modulus (GPa) through a tensile test conducted on a plurality of shaft samples as a necessary antecedent to set the hardness patterns of FIG. 4.

Each one shaft sample is a steel shaft that is a straight pipe (with an outer diameter of 15.50 mm, a thickness of 0.31 mm and a length of 710 mm) made of NSG8655 material by Nisshin Steel Co. Ltd. and that is quenched and thereafter tempered uniformly over the entire length.

A condition of the tensile test is as follows:

Testing device: Instron 5586;

Load cell: Measuring capacity up to 300 kN (made by Instron corporation);

Testing speed; 5 mm/min;

Chucking method: Using a core bar with a length of 65 mm and an outer diameter (an inner diameter of the shaft—0.2 mm);

Shape of test piece: JIS11;

Entire length of test piece: 300 mm

Gauge length: 50 mm;

Distance between chucks: 220 mm; and

Strain gauge stack.

A test result is represented in FIGS. 5 and 6. As shown in FIG. 5, the tensile strength increases as the hardness increases. As shown in FIG. 6, the Young's modulus decreases as the hardness increases.

From the result, the embodiment varies the Young's modulus or the tensile strength in the longitudinal direction of the golf shaft 3 to set the hardness patterns P1 to P5 of FIG. 4 as mentioned above.

In the hardness pattern P3, the tip 3*a* is relatively hard and the butt 3*c* is relatively soft. The hardness pattern P3 is simplified as "hard tip—largely soft butt" relative to the other hardness patterns, The hardness patterns P4 and P5 are relatively simplified as "extremely hard tip—largely soft butt" and "moderately soft tip—hard butt" in the same way, respectively.

As a result of trial hitting conducted using golf clubs with the hardness patterns P3, P4 and P5 (P3, P4 and P5 golf clubs) by the same professional golfer, the P3, P4 and P5 golf clubs are compared with a golf club of a comparative example (comparative golf club) in feeling of use.

The comparative golf club is quenched and tempered uniformly over the entire length of the golf shaft and has hardness varying according to a thickness varying in the longitudinal direction.

The feeling of use of the comparative golf club is popular with many users in swing feeling of a delay of a head at impact and massive feeling at hand.

The P3 golf club is determined to be slightly lighter than the comparative golf club.

The P4 golf club is determined to be light and lack looseness relative to the comparative golf club.

The golf club with the hardness pattern P5 is determined to have massive feeling and unique whip and return. The feeling of use of the P5 golf club is slimier to that of the comparative golf club. The P5 golf club has a release point close to that of the comparative golf club.

In this way, even golf shafts having the same shape can have different feeling types or variations due to different hardness patterns. In addition, the harness patterns are not limited to P1 to P5 of FIG. 4. The hardness pattern may vary according to Young's modulus and tensile strength.

Figure 7:
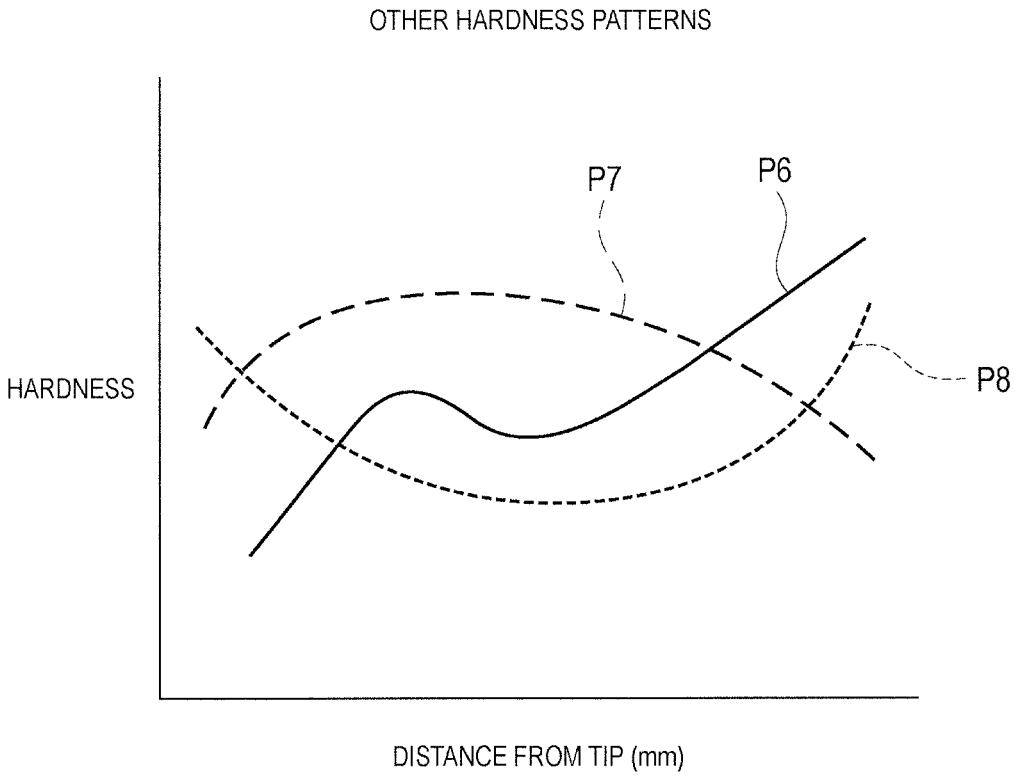
FIG. 7 is a graph illustrating hardness patterns of other variations on the golf shaft according to the embodiment, each one pattern exhibited by hardness varying from a tip to a butt of the corresponding one of the variations on the golf shaft.

FIG. 7 is a graph illustrating hardness patterns of other variations on the golf shaft 3, each one pattern exhibited by hardness varying from the tip to the butt. In FIG. 7, the abscissa represents a longitudinal distance (mm) from the tip 3*a* and the ordinate represents hardness (Hv) like FIG. 4.

As shown in FIG. 7, the hardness patterns P6, P7 and P8 are exhibited by hardness curvedly decreasing or increasing from the tip 3*a* to the butt or grip end 3*c*. In the hardness pattern P6, the hardness increases from the tip 3*a* to the middle of golf shaft 3, decreases in the middle of the golf shaft 3, and thereafter increases to the butt 3*c*. The hardness pattern P7 is convex upward so that the hardness increases from the tip 3*a* to the middle and then decreases to the butt 3*c*. The hardness pattern P8 is convex downward so that the hardness decrease from the tip 3*a* to the middle and then increases to the butt 3*c*.

The golf shaft 3 may have a hardness pattern exhibited by hardness that curvedly and straightly decreases and/or increases from the tip 3*a* to the butt 3*c* according to a combination of FIGS. 4 and 7.

As mentioned above, the embodiment allows the golf shaft 3 to have any hardness pattern for setting feeling of use without change of the shape thereof.

Figures 8, 9:
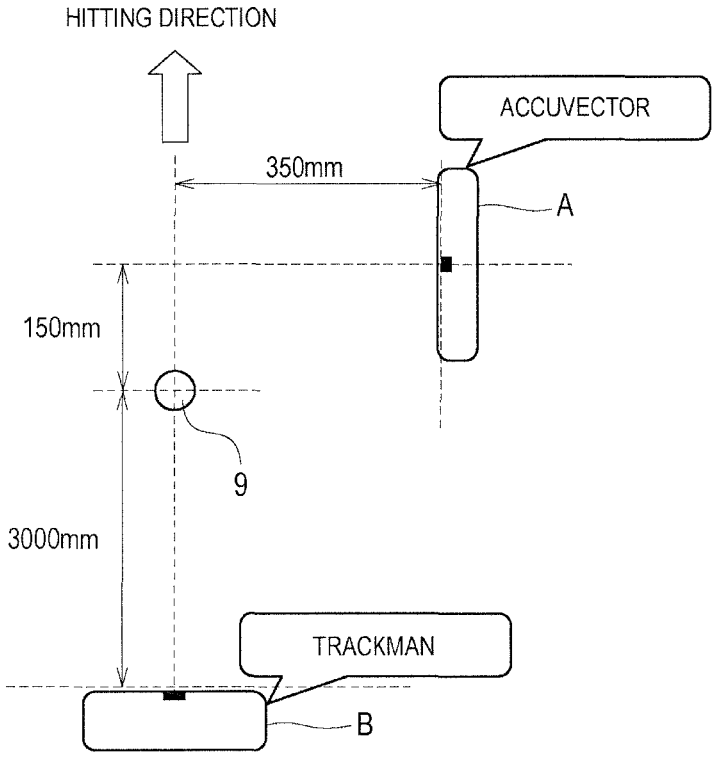
FIG. 8 is a table showing a specification for a golf club applied to evaluation targets according to the embodiment.
FIG. 9 is an explanatory diagram illustrating an arrangement for measuring a distance when hitting a ball with a trial hitting robot.
Figure 10:
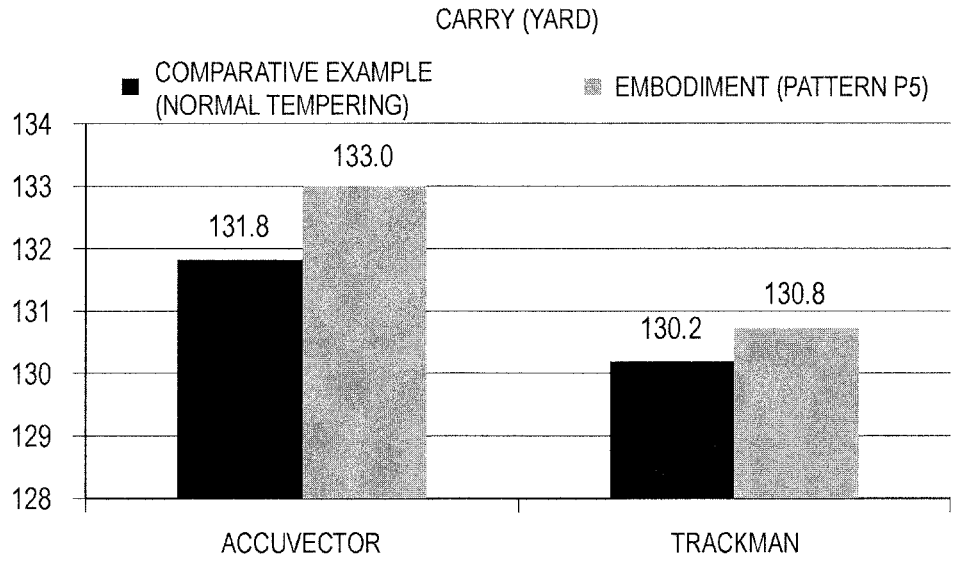
FIG. 10 is a graph illustrating flying distances (carries) measured by the arrangement of FIG. 9 when hitting a ball with a trial hitting robot using respective golf clubs according to the embodiment and a comparative example.
Figure 11:
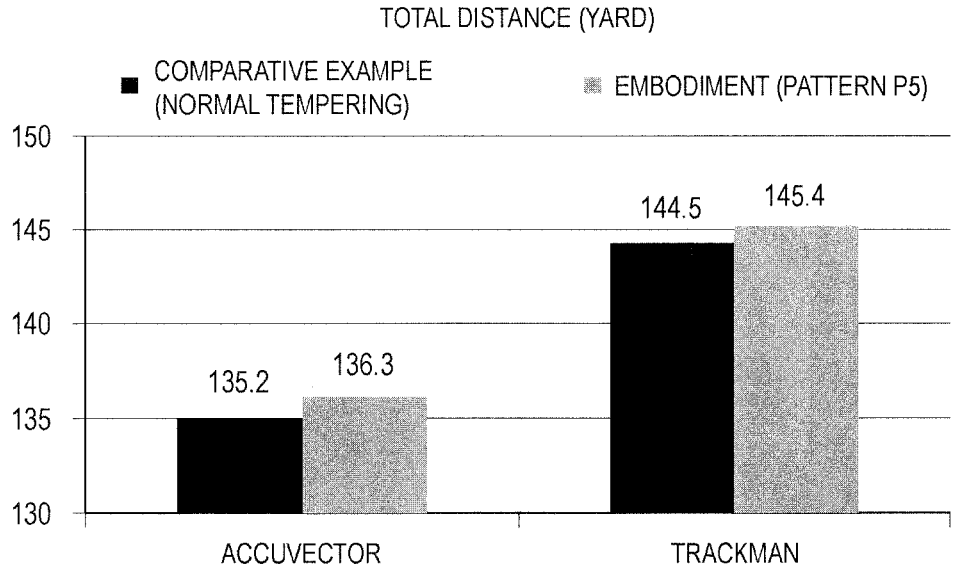
FIG. 11 is a graph illustrating distances (total) measured by the arrangement of FIG. 9 when hitting a ball with a trial hitting robot using respective golf clubs according to the embodiment and the comparative example.

FIG. 8 is a table showing a specification for a golf club applied to evaluation targets. FIG. 9 is an explanatory diagram illustrating an arrangement for measuring a distance when hitting a ball with a trial hitting robot. FIG. 10 is a graph illustrating flying distances (carries) measured by the arrangement of FIG. 9 when hitting a ball with a trial hitting robot using respective golf clubs according to the embodiment and a comparative example, and FIG. 11 is a graph illustrating distances (total) measured by the arrangement of FIG. 9 when hitting a ball with a trial hitting robot using respective golf clubs according to the embodiment and the comparative example.

As illustrated in FIG. 8, the specification applied to the golf clubs that are the evaluation targets according to the embodiment and the comparative example is the 7-iron having a length of 36.75 inches, a weight of 439.7 grams, a balance of D3.0, a lie angle of 62.3°, FP (face progression) of 3.0 mm and a loft angle of 32.0°.

As the comparative example, the golf club has a golf shaft quenched and tempered uniformly over the entire length. As the embodiment, the golf club has a golf shaft with the hardness pattern PS. The golf clubs according to the comparative example and the embodiment used for the trial hitting have the same specification except heat treatment i.e. the hardness pattern.

As illustrated in FIG. 9, the trial hitting uses the trial hitting robot to hit in an arrow direction a golf ball 9 set on a rest and uses the distance-measuring devices A and B to measure a distance of the hit golf ball. The distance-measuring device A is positioned forward with a distance of 150 mm, and rightward with a distance of 350 mm relative to the golf ball 9 set on the rest. The distance-measuring device B is positioned just at the back of the golf ball 9 set on the rest with a distance of 3000 mm.

The robot is adjusted so that so that right-and-left deviation of measured values of the distance-measuring device A is within plus or minus 5 yards in average (of 8 shots). Under this condition, the distance-measuring device B is positioned so that right-and-left deviation of measured values of the distance-measuring device B is within plus or minus 5 yards in average.

As the trial hitting robot, "ROBO-10" made by MIYAMAE CO., LID, is used.

As the distance-measuring device A, "Vector Pro" made by GPRO Co., Ltd. is used. As the distance-measuring device B, "TMANII" made by Trackman company is used. Hereinafter, the distance-measuring device A is also referred to as "AccuVector" and the distance-measuring, device B is also referred to as "Trackman."

A swing pattern of the robot is set to "40M-51-JP2 (fixed waist)," a lie angle of the robot is set to 55°, and a head speed is set to 35 m/s.

The result of the trial hitting is as shown in FIGS. 10 and 11. In FIG. 10, carries are compared. In FIG. 11, total distances including runs are compared.

The carries measured by the AccuVector A are 131.8 yards for the comparative example and 133.0 yards for the embodiment. The carries measured by the Trackman B are 130.2 yards for the comparative example and 130.8 for the embodiment.

The total distances measured by the AccuVector A are 135.2 yards for the comparative example and 136.3 yards for the embodiment. The total distances measured by the Trackman B are 144.5 yards for the comparative example and 145.4 yards for the embodiment.

In this way, the golf shaft having the hardness pattern set according to the embodiment achieves the higher carry and run than those of the comparative example having the same shape and the same specification except the heat treatment.

Considering this as well as the feeling of use of the professional golfer, the effect due to the setting of the hardness pattern is very superior.

Figure 12:
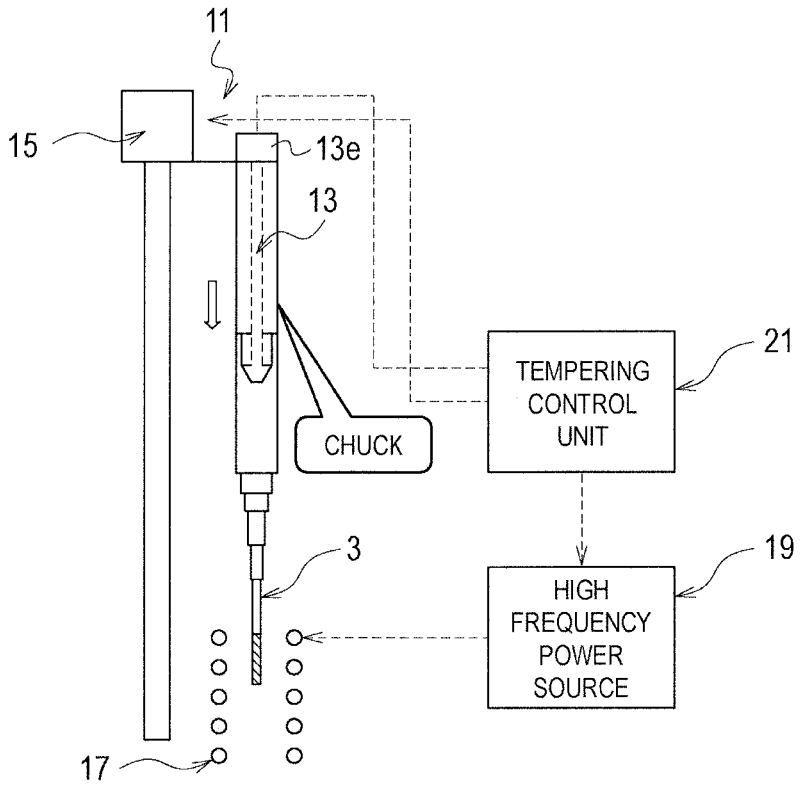
FIG. 12 is a schematic view illustrating a tempering apparatus for the golf shaft according to the embodiment.
Figure 13:
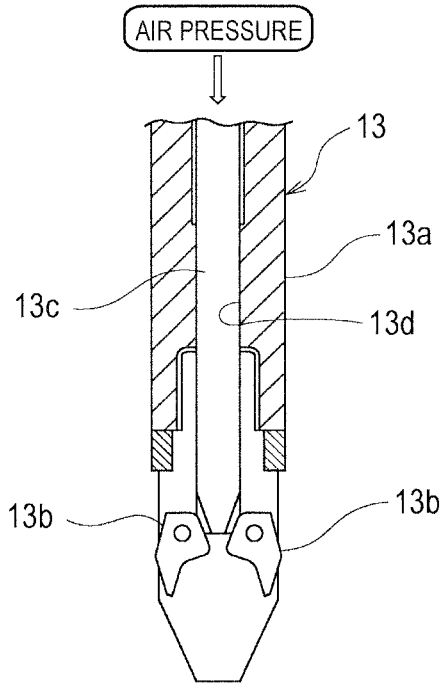
FIG. 13 is a sectional view partly illustrating a chuck of the tempering apparatus of FIG. 12.

FIG. 12 is a schematic view illustrating a tempering apparatus for the golf shaft 3 and FIG. 13 is a sectional view partly illustrating a chuck of the tempering apparatus of FIG. 12.

As illustrated in FIG. 12, the tempering apparatus 11 for the golf shaft 3 includes a chuck 13, a chuck driving unit 15, a heating coil 17, a high frequency power source 19 and a tempering controller 21.

The chuck 13 is configured to hold an end of a shaft. According to the embodiment, the chuck 13 is used to hold the golf shaft 3 on the butt so that the golf shaft 3 is aligned with a central of a coil shape of the heating coil 17.

The chuck driving unit 15 supports the chuck 13 to drive and longitudinally move the chucked golf shaft 3. The chuck driving unit 15 includes a ball screw and a driving motor. The chuck driving unit 15 rotates the ball screw by the motor. With the rotation of the ball screw, the chuck 13 linearly moves downward at a setting speed so that the golf shaft 3 passes downward through the center of the coil shape of the heating coil 17.

The chuck driving unit 15 moves the chuck 13 to hold a quenched golf shaft 3 from a lot (mentioned later) one by one and thereafter return to the original position in the lot.

The heating coil 17 is the heating unit to which a controlled high frequency current is applied and heats the golf shaft 3 longitudinally passing through the heating coil 17. In particular, the heating coil 17 heats at a setting temperature the golf shaft 3 moving downward along a center axis of the coil shape with electromagnetic induction according to control of voltage applied to the heating coil 17.

The high frequency power source 19 supplies a high frequency current to the heating coil 17 to apply a setting voltage thereto.

In addition, the embodiment may employ a different heating unit such as radiant heater that allows the shaft to be heated for tempering without electromagnetic induction.

The tempering control unit 21 controls the chuck driving unit 15 and the heating coil 17 to vary in the longitudinal direction of the golf shaft 3 the setting temperature of the heating of the heating coil 17 and the setting speed at which the golf shaft 3 passes through the heating coil.

Namely, the tempering control unit 21 is electrically connected to the chuck driving unit 15 and the high frequency power source 19 to control them according to preset programs. For the chuck driving unit 15, the control unit 21 controls a driving speed to control the descending speed of the golf shaft 3 relative to the heating coil 17 to the setting speed. For the high frequency power source 19, the control unit 21 carries out energizing control to control the high frequency current applied to the heating coil 17. With the energizing control, the control unit 21 controls the voltage applied to the heating coil 17, thereby to control the heating temperature of the golf shaft 3 moving downward along the center axis of the coil shape of the heating coil 17 to the setting temperature.

That is, the tempering control unit 21 controls the high frequency power source 19 and the chuck driving unit 15 to vary the setting temperature for heating the golf shaft 3 and the setting speed for moving the golf shaft 3 downward, respectively.

As illustrated in FIG. 13, the chuck 13 has a chuck base 13*a*, chuck claws 13*b* and a chuck core bar 13*c*.

The chuck base 13*a* is a hollow cylinder and rotatably supports the chuck claws 13*b* on a front end thereof. The chuck base 13*a* has a guide hole 13*d* on a shaft center and supports the chuck core bar 13*c* with the guide hole 13*d*. A front end of the chuck core bar 13*c* faces a space between the chuck claws 13*b*. The guide hole 13*d* is connected to an air supply unit through a switching valve 13*e* for turning air supply on and off. The switching valve 13*e* is connected to and controlled by the tempering control unit 21.

The chuck 13 moves for holding a quenched golf shaft 3 under the control of the tempering control unit 21. At this time, the switching valve 13*e* is switched to turn the air supply on and air is supplied from the air supply unit to the guide hole 13*d*. With this air supply, air pressure acts on an upper end of the chuck core bar 13*c* and the chuck core bare 13*c* descends along the guide hole 13*d*. Accordingly, the chuck core bar 13*c* pushes the pair of the chuck claws 13*b* apart.

The pushed-apart chuck claws 13*b* protrude from the chuck base 13*a* laterally. The protruding chuck claws 13*b* contact and engage with the golf shaft 3 that is fitted to the front end of the chuck base 13*a* from within. With this engagement, the chuck 13 holds an upper part of the golf shaft 3 as illustrated in FIG. 12.

In addition, the chuck 13 may be configured to rotate in a circumferential direction in order to heat the golf shaft 3 further uniformly in the circumferential direction.

The heat treatment according to the embodiment includes a quenching step quenching a whole tube at once and a tempering step tempering the quenched tube. In the tempering step, a tempering condition varies in the longitudinal direction of the tube.

The quenching step is carried out to non-heat treated golf shafts or tubes by unit of lot. In particular, the non-heat treated golf shafts are collectively accommodated in a basket so that the butts are oriented upward. The accommodated golf shafts are heated by unit of lot entirely at a uniform temperature with an electric furnace and thereafter are immersed into an oil tank to conduct oil quenching. With the quenching step, each one golf shaft is entirely quenched at once.

At the quenching, the material of the golf shaft becomes a martensite structure. Subsequently, the tempering step is carried out to recover toughness and achieve strength and durability of the golf shaft 3.

The tempering step uses the tempering apparatus 11 to conduct tempering process while varying the tempering condition in the longitudinal direction of the golf shaft 3. Namely, the tempering apparatus 11 holds the quenched golf shaft 3 to conduct the heating to the quenched golf shaft 3 at the setting temperature with the heating coil 17 and the downward movement of the quenched golf shaft 3 at the setting speed relative to the heating coil 17. The heating at the setting temperature and the downward movement at the setting speed compose the tempering condition.

The tempering step, therefore, varies in the longitudinal direction of the golf shaft 3 the heating at the setting temperature and the downward movement at the setting speed according to the setting program stored in the tempering control unit 21, thereby to easily obtain any one of the hardness patterns in FIGS. 4 and 7 etc.

When holding the golf shaft 3, the chuck 13 moves from an original position toward the group of the quenched golf shafts 3 in the lot according to the tempering control unit 21, the quenched golf shafts 3 accommodated in the basket and transferred to a holding position after quenching. Then, the chuck 13 at the front end fits the butt 3*c* of one of the quenched golf shafts 3 in the lot and holds the one quenched golf shaft 3 by pushing the chuck claws 13*b* apart according to the air supply under the control of the tempering control unit 21.

After holding, the one quenched golf shaft 3 with the chuck 3, the chuck 13 moves hack to the original position under the control of the tempering control unit 21 to arrange the chucked golf shaft 3 above the heating coil 17 and align the chocked golf shaft 3 with the center axis of the coil shape of the heating coil 17. Then, both the heating at the setting temperature and the downward movement at the setting speed are conducted.

In the heating at the setting temperature, the tempering control unit 21 controls the high frequency power source 19 to control heat generation of the golf shaft 3 due to the electromagnetic induction using the heating coil 17. The setting temperature depends on a voltage applied to the heating coil 17 according to the energizing control and therefore is controlled according to a value of the voltage applied to the heating coil 17.

In the downward movement at the setting speed, the tempering control unit 21 controls the chuck driving unit 15 to move the golf shaft 3 downward with respect to the heating coil 17. The setting speed is controlled as a speed at which the golf shaft 3 downward passes through the heating coil 17.

Figure 14:
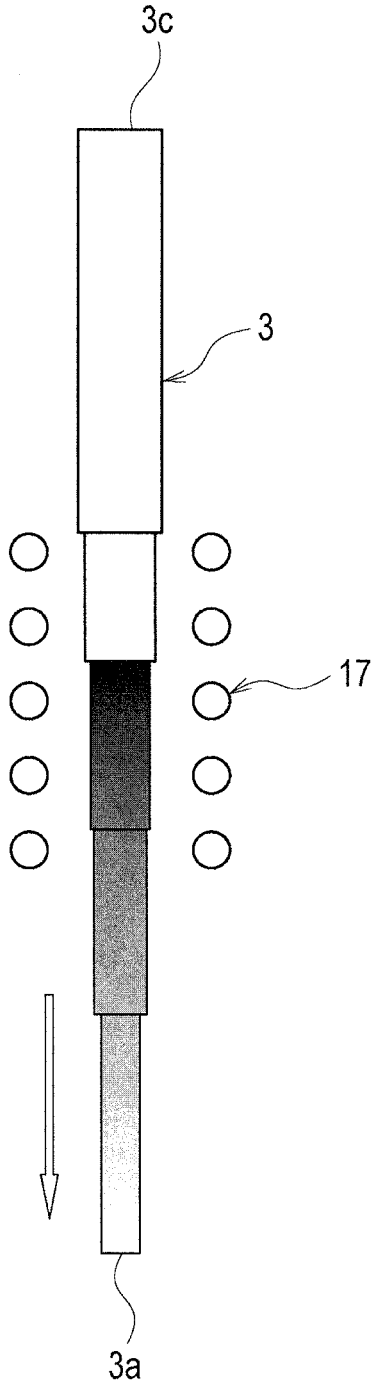
FIG. 14 is a schematic view illustrating an example of a heating condition of the golf shaft according to the embodiment.

Based on the heating temperature and the downward-moving speed, the golf shaft 3 is heated from the tip 3*a* as illustrated in FIG. 14. In FIG. 14, the degree of the heating is represented by contrasting density.

After the heating is conducted up to the butt 3*c*, the tempering control unit 21 switches the switching valve 13*e* so as to turn the air supply off. The air pressure is released from the chuck core bar 13*c*. In response to the air pressure release, the chuck claws 13*b* close by their own weights to release the golf shaft 3, and the released golf shaft 3 drops without changing the attitude.

The drop golf shaft 3 is directly cooled with air so that tensile strength and Young's modulus are set so as to vary in the longitudinal direction of the golf shaft 3. According to the setting, the hardness is set at each part of the golf shaft 3 in the longitudinal direction and the toughness is recovered to maintain or achieve strength and durability of the golf shaft 3.

In this way, the method of manufacturing the golf shaft 3 varies the heating temperature and the downward-moving speed when heating the quenched golf shaft 3 from the tip 3*a* to the butt 3*c*, thereby to set a desired or an arbitrary hardness pattern on the golf shaft 3.

For example, for the hardness pattern P5 in FIG. 4, the heating temperature is set so as to gradually lower from the tip 3*a* to the butt 3*e* i.e. the heating temperature is relatively high on the tip 3*a* and relatively low on the butt 3*c*. The downward-moving speed is set according to the inclination of the hardness pattern P5 based on the heating temperature. For the hardness patterns P1 to P4 in FIG. 4, the heating temperature is set so as gradually increase from the tip 3*a* to the butt 3*c* i.e. the heating temperature is relatively low on the tip 3*a* and relatively high on the butt 3*c*.

For the hardness patterns P6 to P8 in FIG, 7, the downward-moving speed is set so as to be increased or reduced in the middle.

As mentioned above, the golf shaft 3 as a metal shaft according to the embodiment includes the hollow tube 3A made of metal. The tube 3A or golf shaft 3 has the hardness pattern P1 to P8 exhibited by hardness of the golf shaft 3 varying in the longitudinal direction of the golf shaft 3 according to Young's modulus or tensile strength of the metal varying in the longitudinal direction of the golf shaft 3 through the tempering process.

Accordingly, the embodiment achieves different golf clubs 1 having different types of feeling of use, different ball distances and the like by varying Young's modulus or tensile strength in the longitudinal direction of the golf shafts 3 while the golf shafts 3 have the same length, sectional shape, thickness and the like. This prevents increase in the number of variations on the shape of the golf club 1 and the golf shaft 3.

In particular, the golf shaft 3 can have a different hitting feel and a different ball trajectory of the golf shaft 1 by setting a different hardness distribution of the golf shaft 3 while maintaining the same shape.

Although the golf shaft 3 maintains the same shape, the golf shaft 3 can have the different strength distribution to keep a balance as the golf club 1.

Accordingly, the embodiment achieves various golf shaft 3 in characteristics while keeping the same shape. This reduces the number of variations on the shape of the golf shaft 3 and stabilizes quality of the golf shaft 3. The embodiment, however, may longitudinally vary hardness patterns of the golf shafts with different shapes based on the same tempering process.

Further, a design for weight saving and a design for characteristics can be separated so as not to interfere with each other. The embodiment, therefore, can provide the golf club 1 having a specification (of a kick point etc.) suited for each user while saving the weight.

The hardness exhibiting the hardness pattern of the golf shaft 3 curvedly and/or straightly decreases or increases from the tip 3*a* to the butt 3*c*.

Accordingly, any hardness pattern such as hardness patterns P1 to P8 is freely set to the golf shaft 3, thereby to provide variations on the golf shaft 3 having different types of feeling of use and/or different distances of a ball while keeping the same shape.

The method of manufacturing the golf shaft 3 includes the quenching step entirely quenching the tube 3A or the golf shaft 3 made of metal at once, and the tempering step tempering the quenched golf shaft 3 while varying the tempering condition in the longitudinal direction of the golf shaft 3.

The method, therefore, easily varies the Young's modulus or tensile strength in the longitudinal direction of the golf shaft 3 to freely set any hardness pattern such as hardness patterns P1 to P8.

The tempering step heats the quenched golf shaft 3 at the setting temperature with the heating coil 17 while longitudinally passing the quenched golf shaft 3 through the heating coil 17 at the setting speed, the setting temperature and the setting speed varying as the tempering condition. To the heating coil 17, the controlled high frequency current is applied. The setting temperature is a temperature depending on the voltage to be applied to the heating coil 17, and the setting speed is a speed at which the quenched golf shaft 3 passes through the center of the coil shape of the heating coil 17.

Accordingly, the setting temperature is easily varied in the longitudinal direction of the quenched golf shaft 3 by controlling the voltage to be applied to the heating coil 17 and the setting speed is easily varied by controlling the speed at which the quenched golf shaft 3 passes through the center of the coil shape of the heating coil 17.

The tempering device 11 includes the chuck 13 holding the end (butt 3*c*) of the tube 3A or golf shaft 3 made of metal, the chuck driving unit 15 driving the chuck 13 to longitudinally move the chucked golf shaft 3, the heating coil 17 as the heating unit heating at the setting temperature the golf shaft 3 longitudinally passing through the heating coil 17 at the setting speed, and the tempering control unit 21 controlling the heating coil 17 and the chuck driving unit 15 to vary the setting temperature and/or the setting speed in the longitudinal direction of the golf shaft 3. The tempering control unit 21 controls the high frequency power source 19 to vary the setting temperature and the chuck driving unit 15 to vary the setting speed.

The tempering device 11, therefore, holds the end of the golf shaft 3 with the chuck 13 and longitudinally moves with the chuck driving unit 15 the chuck golf shaft 3 along the central of the coil shape of the heating coil 17. At this time, the tempering device 11 varies the setting speed at which the golf shaft 3 passes through the heating coil 17 and the setting temperature of the heating with the heating coil 17 in the longitudinal direction of the golf shaft 3, thereby to vary Young's modulus or tensile strength of the golf shaft 3 in the longitudinal direction for setting any hardness pattern such as hardness patterns P1 to P8.

According to the present invention, the metal shaft, the method of manufacturing the metal shaft and the tempering apparatus are applicable to any metal shaft product other than the golf shaft such as bat for baseball or softball, ski pole, trekking pole, and TV antenna for which hardness may be set by the tempering after the quenching. Such metal shaft products other than the golf shaft can provide the same effect as the embodiment of the golf club.

In particular, the bat may have the constant weight by varying a hardness pattern without changing the shape. The ski pole and trekking pole have an appropriate sticking feel suited for each player while reducing the weight. The TV antenna has an appropriate wind resistance while reducing the weight.

According to the embodiment, the setting temperature and the setting speed vary as the tempering condition. In some cases, however, at least one of the setting temperature and the setting speed may vary as the tempering condition.

What is claimed is:

1. A metal shaft comprising a hollow tube made of metal, wherein the tube has a hardness pattern exhibited by hardness of the tube varying in a longitudinal direction of the tube according to Young's modulus or tensile strength of the metal varying in the longitudinal direction, so that the hardness relatively increases as the tensile strength relatively increases or as the Young's modulus relatively decreases and the hardness relatively decreases, as the tensile strength relatively decreases or as the Young's modulus relatively increases in the hardness pattern.

2. A golf shaft comprising the metal shaft of claim 1, wherein the tube of the metal shaft includes a head-attaching portion to which a head is attached on a tip, and a grip-attaching portion to which a grip is attached on a butt.

3. The golf shaft of claim 2, wherein the hardness of the tube exhibiting the hardness pattern curvedly and/or straightly decreases or increases from the tip to the butt.

4. A golf club comprising the golf shaft of claim 2, further comprising:

a head attached to the head-attaching portion of the golf shaft; and a grip attached to the grip-attaching portion of the golf shaft.

5. A method of manufacturing the metal shaft of claim 1, comprising:

quenching a non-heat treated tube made of metal so that the material of the quenched tube becomes a martensite structure entirely; and tempering the quenched tube while varying a tempering condition in a longitudinal direction of the tube to control the Young's modulus or tensile strength of the tempered tube, thereby to give the tempered tube the hardness pattern exhibited by the hardness of the tube varying in the longitudinal direction of the tube according to the controlled Young's modulus or tensile strength so that the hardness relatively increases as the tensile strength relatively increases or as the Young's modulus relatively decreases, and the hardness relatively decreases as the tensile strength relative decreases or as the Young's modulus relatively increases in the hardness pattern.

6. The method of claim 5, wherein the tempering step heats the quenched tube at a setting temperature with a heating unit while longitudinally passing the quenched tube through the heating unit at a setting speed, the setting temperature and/or the setting speed varying as the tempering condition.

7. The method of claim 6, wherein the heating unit is a heating coil to which a controlled high frequency current is applied, wherein the setting temperature is a temperature depending on a voltage to be applied to the heating coil, and wherein the setting speed is a speed at which the quenched tube passes through a center of the heating coil.

8. The method of claim 5, wherein the quenching is correctively performed to a plurality of non-heat treated tubes so that the plurality of non-heat treated tubes become the martensite structure all at once, and wherein the tempering is performed to the plurality of the quenched tubes one by one to control the Young's modulus or tensile strength of each one of the tempered tubes.

* * * * *